US005149096A

United States Patent [19]

Keating et al.

[11] Patent Number: 5,149,096

[45] Date of Patent: Sep. 22, 1992

[54] HOCKEY PUCK

[76] Inventors: Michael D. Keating, 6231 Sixth St. N., Oakdale, Minn. 55119; Robert W. Norris, 6704 Wooddale Ave., Minneapolis, Minn. 55435; Ronald K. Jakubas, 7761 Clinton Rd., Jackson, Mich. 49201

[21] Appl. No.: 788,133

[22] Filed: Nov. 5, 1991

Related U.S. Application Data

[63] Continuation-in-part of Ser. No. 277,957, Nov. 30, 1988, which is a continuation of Ser. No. 33,011, Mar. 31, 1987, abandoned.

[51] Int. Cl.[5] ..... A63B 71/00

[52] U.S. Cl. ..... 273/128 R

[58] Field of Search ..... 273/128 R, 126 R, 187 CS

[56] References Cited

U.S. PATENT DOCUMENTS

| | | | |
|---|---|---|---|
| 2,606,030 | 8/1952 | Tjomsland | 273/128 R |
| 3,188,088 | 6/1965 | Gatke | 273/125 CS |
| 3,533,626 | 10/1970 | Smith | 273/128 R |
| 3,610,625 | 10/1971 | Erro | 273/128 R |
| 3,784,204 | 1/1974 | Felber | 273/128 R |

FOREIGN PATENT DOCUMENTS

| | | | |
|---|---|---|---|
| 680107 | 2/1964 | Canada | 273/128 R |

*Primary Examiner*—Theatrice Brown
*Attorney, Agent, or Firm*—John C. Barnes

[57] ABSTRACT

An ice hockey puck has more uniform play during a period when provided with projections positioned circumferentially about the end surfaces which lift the puck from the surface to reduce the snow plowing effect, and the stability of the puck is maintained when the projections are dome-shaped to terminate in arcuate or flat ends.

6 Claims, 2 Drawing Sheets

HOCKEY PUCK

BACKGROUND OF THE INVENTION

1. Related applications

This application is a continuation in part of application Ser. No. 07/277,957 filed Nov. 30, 1989, which was a continuation of application Ser. No. 07/033,011 filed Mar. 31, 1987, now abandoned.

2. Field of the Invention

This invention relates to an improvement in a sports game piece, and in one aspect, to an improved hockey puck for the game of ice hockey.

3. Description of the Prior Art

Hockey pucks have traditionally been the same black cylindrical shape, about 3 inches in diameter, and one inch thick, weighing about 5½ to 6 ounces. The outer cylindrical edge is knurled or ribbed with ridges and grooves following a generally helical path. They are generally formed of vulcanized rubber. Major manufacturers of the conventional pucks are the Viceroy Manufacturing Company and the Sherbrooke Drolet Company.

The traditional black hockey puck will cause black marks to form on the transparent wall of plexiglass surrounding the rink above the boards when the puck strikes the wall, and continual maintenance to clean the same for the spectators is required.

Further, the standard hockey puck becomes slower as the ice is worn, developing a snow condition, making the control of the puck more difficult for the players. The roughened and loosened ice slows the traditional puck as it has a snow plowing effect as it is moved over the ice and, at that time, greater attention by the player is required to maintain control of the hockey puck.

Hockey players tape the blade of the hockey sticks and this is usually done with a black tape. Such tape with the black puck makes the puck harder to see coming off the stick. Having a puck which is harder to see against the black background of the tape is thus more dangerous to players and fans.

The hockey puck of the present invention meets the size and weight requirements of the standard hockey puck which is regulation with the game. The hockey puck of the present invention reduces the snow plowing effect that the hockey puck has with the ice, and particularly, as the ice becomes loosened and a snow develops on the surface. The hockey puck of the present invention moves more consistently and rapidly on the ice and affords greater control of the puck by the hockey player. The hockey puck may have dome shaped projections which are arcuate or flat on their outer surface. The flat surfaces on the projections give the puck the advantages of the rounded profile, in that they lift the puck off the surface of the ice and reduce the snow plow effect, but the flat ends on the projections give the puck more stability, due to the increased contact area with the rough and wet ice. A puck having the projections will travel more uniformly over the ice during the entire period of play.

SUMMARY OF THE INVENTION

The hockey puck of the present invention comprises a 5½ to 6 ounce cylindrically object 3 inches in diameter and one inch thick. The puck is provided with an outer cylindrical side surface which may be conventionally knurled to increase the frictional surface of the outer side wall. The puck is provided with axially spaced end walls, each being formed with at least three symmetrically circumferentially spaced circular projections having a domed, arcuate or flat, profile. In a preferred embodiment the projections, and end walls, including the projections, have a coating of material having a lower coefficient of friction than the material of the hockey puck. A preferred coating is polytetrafluoroethylene. A ring or band of a material, formed of the same material as the puck, but of a color different than the puck is inset in the puck around the central portion of the periphery of the side wall of the puck. The entire side wall of the puck including the band is knurled.

BRIEF DESCRIPTION OF THE DRAWINGS

The present invention will be further described with reference to the accompanying drawing wherein.

DESCRIPTION OF THE PREFERRED EMBODIMENT

Figure 1:
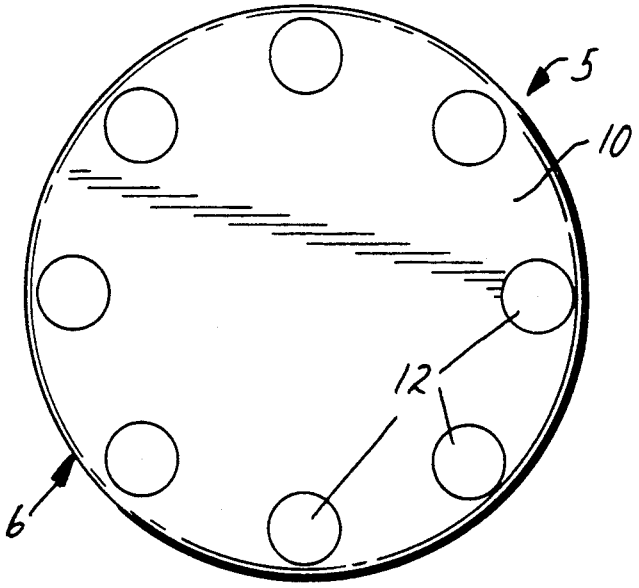
FIG. 1 is a top plan view of the hockey puck, the bottom view is the same.
Figure 2:
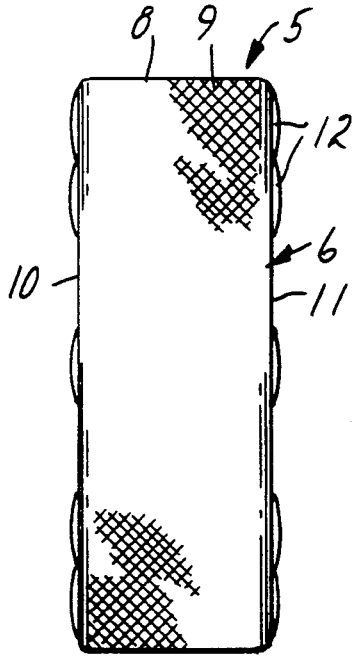
FIG. 2 is a side elevational view of the hockey puck.

The present invention provides an improved hockey puck, generally designated 5, having a body 6 of the conventional circular or cylindrical shape with a thickness of about one inch (2.54 cm) and 3 inches (7.62 cm) in diameter. The outer cylindrical edge 8 of the puck is formed with ridges and grooves or a knurled surface, affording increased friction as designated by the knurled pattern 9.

Figure 3:
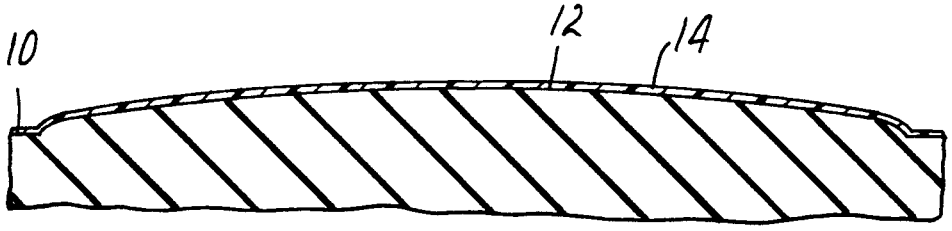
FIG. 3 is a detailed fragmentary elevational view of one of the projections on one end of the hockey puck.

Projecting from each of the end surfaces 10 and 11 are plurality of circular projections 12 positioned adjacent the outer wall and spaced symmetrically with respect to the periphery of the surface. Each projection has a height of between about 0.01 to 0.04 inch (0.25 to 1 mm), preferably 0.020 to 0.025 inch (0.5 to 0.6 mm) above the surface and has a radius of between 0.05 to 0.25 inch (1.27 to 6.35 mm) preferably 0.187 inches (4.75 mm). The projection is generally domed-shaped or arcuate, and, as illustrated in FIG. 3, the profile is not formed on a predetermined center to be like that of a hemisphere but tapers from the center point toward each of the edges of the projections where a small radiused edge is formed at the base of the projection. There are at least 3 projections 12, but, preferably 8 projections are spaced equally about the center.

The center of the projection is about 1.25 inches (3.17 cm) from the center of the hockey puck, and the total thickness of the hockey puck from the top of one projection on one side 10 to the top of the projection 12 on the other side 11 is about 1.032 inches (2.62 cm).

These projections and the end, as illustrated in FIG. 3, are preferably provided with a coating 14 of polytetrafluorethylene, affording a coefficient of friction for the projections and end walls which is less than the coefficient of the material forming the body of the hockey puck.

Figure 4:
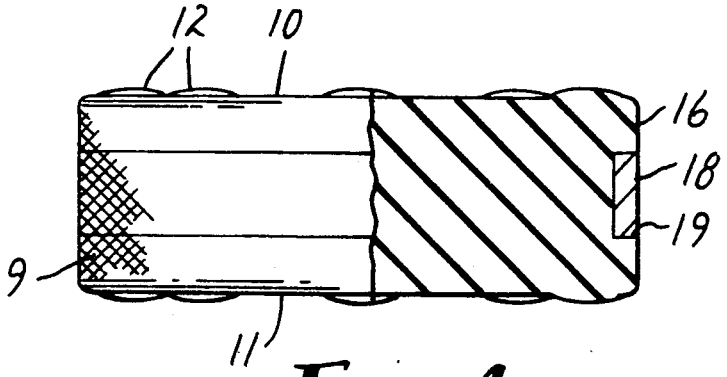
FIG. 4 is a vertical fragmentary sectional view of a further embodiment of a hockey puck constructed according to the present invention.

In FIG. 4 there is illustrated a second embodiment of a hockey puck constructed according to the present invention wherein the body 16 is molded with a band 18 of material formed of a color differing from the black black color of the puck. This band is formed of the same material as the puck but has a pigment added to give it a fluorescent color, orange or green. The band 18 is 0.500±0.300 to 0.510±0.005 inch wide (1.27 to 13 mm) and is in a groove 19 0.125±0.010 inch (3 to 3.3 mm) deep. The band 18 is flush with the edge wall. The edge wall and band 18 are both knurled. The band 18 provides higher visibility of the puck, for the players and for the fans.

Figure 5:
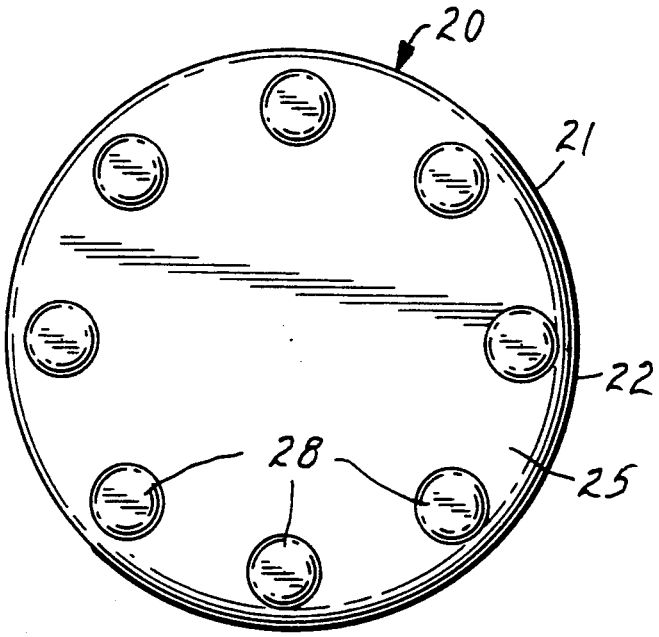
FIG. 5 is a top plan view of another embodiment of the hockey puck of the present invention, the bottom view is the same.
Figure 6:
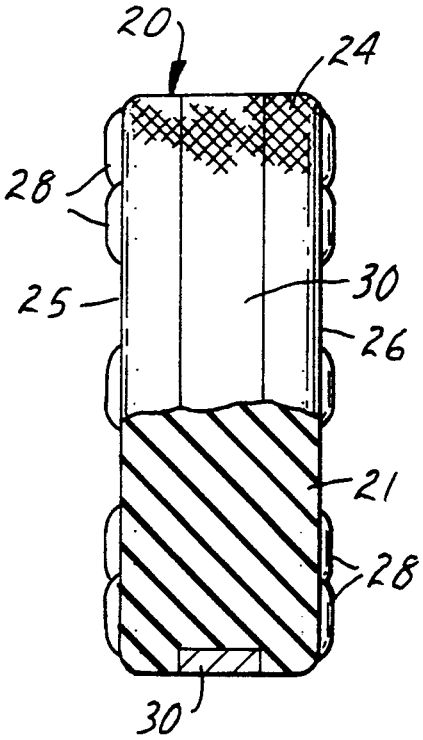
FIG. 6 is a side elevational view of the hockey puck of FIG. 5, partially in section.
Figure 7:
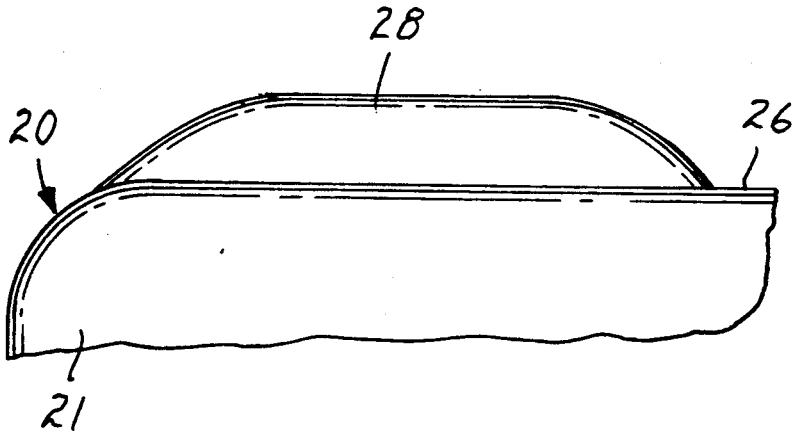
FIG. 7 is a detailed fragmentary elevational view of one of the projections on one end of the hockey puck of FIG. 5.

A further embodiment is illustrated in FIGS. 5, 6 and 7. The hockey puck 20 has a body 21 of the conventional circular or cylindrical shape with a thickness of about one inch (2.54 cm) and 3 inches (7.62 cm) in diameter. The outer cylindrical edge 22 of the puck is formed with ridges and grooves or a knurled surface, affording increased friction as designated by the knurled pattern 24, see FIG. 6.

Projecting from each of the end surfaces 25 and 26 are a plurality of circular projections 28 positioned adjacent the outer wall of the puck and spaced symmetrically with respect to the periphery of the surface. Each projection has a height of between about 0.01 to 0.04 inch (0.25 to 1 mm), preferably 0.022 to 0.028 inch (0.5 to 0.7 mm) above the end surface and has a radius of between 0.05 to 0.25 inch (1.27 to 6.35 mm) preferably 0.187 inches (4.75 mm). The projections 28 are generally domed-shaped and in this embodiment have a flat end surface, and, as illustrated in FIG. 7, the profile is flat with blended radii leading to the edges and base of the projections. The edges are at an angle of about 45 degrees, between 44 and 46 degrees, to the end surface, 25 or 26, of the puck 20. The projections terminate with flat surfaces parallel to each other and to the surface of the puck. There are at least 3 projections 28, but, preferably 8 projections are equally spaced circumferentially and about the center of the puck. The projections are positioned as near the edge of the end surfaces 25 and 26 as possible, so the tangents of the circles formed by the radii joining the edges to the surface and the radiused edge of the puck coincide.

The center of the projections are about 1.25 inches (3.17 cm) from the center of the hockey puck, and the total thickness of the hockey puck from the top of one projection on one side 25 to the top of the projection 28 on the other side 26 is about 1.032 inches to 1.09 inches (2.62 cm to 2.77 cm).

The entire hockey puck 20 can be provided with a coating of a material affording a coefficient of friction for the projections 28 and end walls, 25 and 26, which is less than the coefficient of friction of the material forming the body of the hockey puck 20. An example of such a material is polytetrafluorethylene. The puck 20 may also have a band 30 about its periphery similar to the band 18.

The body 6, 16 or 20 of the puck may be formed of vulcanized rubber as is standard, but is preferably formed of a mixture of material having a durometer measure similar to that of vulcanized rubber. The example of a material is:

| Product | Supplier | Parts by Weight |
|---|---|---|
| Copo 1502 | Copolymer, Inc. | 100 |
| Hard clay | | 37.5 |
| Cumar Resin H2.5 | | 5 |
| Carnauba Wax | | 2 |
| Zinc oxide | | 5 |
| Stearic acid | | 1 |
| Sulfur | | 10 |
| Methyl tuads | | 0.6 |
| Altax | R. T. Vanderbilt | 2 |
| Carbon black N550 | | 2 |
| Whiting | | 37.5 |

Other suitable polymeric materials may be suitable thermoplastic rubbers (TPR) having a durometer measure of 65 to 90. The bands 18 and 30 are placed into the groove, see 19 in FIG. 4, and is also formed of the same material except the pigment is a fluorescent pigment of orange or green and not carbon black.

Having thus described the invention it is to be appreciated that modifications may be made in material or in some dimensions and not depart from the spirit of the invention as defined in the appended claims.

We claim:

1. A hockey puck having a body of a circular shape and thickness of a conventional hockey puck, said body having oppositely projecting spaced ends, characterized in that each end has at least three symmetrically circumferentially spaced circular dome shaped projections formed integrally with said body on said ends and extending therefrom between 0.01 to 0.04 inch and terminating with a dome-shaped end surface substantially parallel to each other and to the surface of the puck.

2. A hockey puck according to claim 1 wherein said projections terminate in flat surfaces.

3. A hockey puck according to claim 2 wherein the projections and end portions of the puck are coated with polytetrafluoroethylene.

4. A hockey puck according to claim 1 or claim 2 wherein said projections have a diameter of about 0.375 inch at their base.

5. A hockey puck according to claim 1 or 2 wherein said projections extend from said ends between about 0.02 and 0.025 inch.

6. A hockey puck according to claim 1 wherein there are eight projections which are domed-shaped and symmetrically spaced near the periphery of each end.

* * * * *